US005358577A

United States Patent [19]

Uehara et al.

[11] Patent Number: 5,358,577

[45] Date of Patent: Oct. 25, 1994

[54] HIGH STRENGTH AND HIGH TOUGHNESS MARTENSITIC STAINLESS STEEL AND METHOD OF MANUFACTURING THE SAME

[75] Inventors: Toshihiro Uehara, Yasugi; Rikizo Watanabe, Mooka; Nobuhito Nakama, Kawanishi, all of Japan

[73] Assignees: Hitachi Metals, Ltd.; The Society of Japanese Aerospace Companies, Inc.; Sumitomo Precision Products Co., Ltd., Tokyo, Japan

[21] Appl. No.: 93,860

[22] Filed: Jul. 20, 1993

Related U.S. Application Data

[60] Division of Ser. No. 893,888, Jun. 4, 1992, Pat. No. 5,288,347, which is a continuation of Ser. No. 704,927, May 23, 1991, abandoned.

[30] Foreign Application Priority Data

May 28, 1990 [JP] Japan ..... 2-137560
Feb. 8, 1991 [JP] Japan ..... 3-039147

[51] Int. Cl.[5] ..... C22C 38/52

[52] U.S. Cl. ..... 148/325; 148/326; 148/605; 148/607; 420/37; 420/38

[58] Field of Search ..... 148/325, 326, 605, 607; 420/37, 38

[56] References Cited

FOREIGN PATENT DOCUMENTS 7201424 8/1973 Netherlands .

*Primary Examiner*—Richard O. Dean
*Assistant Examiner*—Sikyin Ip
*Attorney, Agent, or Firm*—Antonelli, Terry, Stout & Kraus

[57] ABSTRACT

A high strength, high toughness stainless steel consisting, by weight, of C more than 0.16% but less than 0.25%, Si not more than 2.0%, Mn not more than 1.0%, Ni not more than 2.0%, Cr from 11 to 15%, Mo not less than 0.5% but less than 3.0%, Co from 12 to 21%, at least one kind selected from the group consisting of V from 0.1 to 0.5% and Nb less than 0.1% which at least one kind is added as occasion demands, and the balance Fe and incidental impurities. This steel is produced by a method comprising the steps of: preparing a stainless steel having the composition of any one of the claims 1 to 4; subjecting the stainless steel to a solution heat treatment at a temperature of 950 to 1150° C.; quenching the steel; subjecting the steel to a sub zero treatment at a temperature of −50° to −100° C.; and subjecting the steel to a tempering at a temperature of 120° to 450° C.

8 Claims, No Drawings

HIGH STRENGTH AND HIGH TOUGHNESS MARTENSITIC STAINLESS STEEL AND METHOD OF MANUFACTURING THE SAME

This is a division of application Ser. No. 07/893,888, filed Jun. 4, 1992, now U.S. Pat. No. 5,288,347 which is a continuation application of Ser. No. 07/704,927, filed May 23, 1991, abandoned.

FIELD OF THE INVENTION

The present invention relates to a high strength, high toughness stainless steel suitably applicable to a member requiring high strength and high toughness as well as corrosion resistance.

BACKGROUND OF THE INVENTION

In general, high strength and low alloy steel represented by AISI4340,300M and the like are known well as a high strength material. These materials can provide high strength of about 180 Kgf/mm$^2$ or more, when heat treatment conditions are selected. However, since these materials are low alloy steels and contain a small amount of Cr of 1% or less which greatly contributes to corrosion resistance, they have poor corrosion resistance. Thus, when these materials are used to an application requiring corrosion resistance, they have been conventionally subjected to a surface treatment such as Cr plating, Ni plating and the like. Nevertheless, the method of improving the corrosion resistance thereof by the surface treatment has problems in that the method needs many processes, when a surface treated layer is peeled, the peeled portion is partially corroded, and further the surface treatment is difficult to be carried out depending upon parts or locations.

On the other hand, generally stainless steel is often used to an application in which corrosion resistance is an important factor. Although stainless steel has excellent corrosion resistance, austenitic stainless steel represented by SUS304 and ferritic stainless steel represented by SUS430 and the like, which are known well, have low strength, and thus it is not suitable to an application simultaneously requiring corrosion resistance and strength. On the other hand, a precipitation hardening type stainless steel has high strength, which can be increased in such a manner that the stainless steel is age-hardened by an aging treatment. Well known commercially available precipitation hardening type stainless steel includes 17-4PH, 15-5PH, PH13-8Mo and the like. The strength of these precipitation hardening type stainless steels is about 120 Kgf/mm$^2$ in the case of 17-4PH, about 135 Kgf/mm$^2$ in the case of 15-5PH, and about 150 Kgf/mm$^2$ in the case of PH13-8Mo, although it changes depending upon aging treatment conditions.

Although these precipitation hardening type stainless steels have high strength, the strength is lower than that of 4340,300M and the like as high strength low alloy steel. Therefore, these existing precipitation hardening type stainless steels cannot be used to an application in which both high strength similar to that of 4340 or 300M and corrosion resistance similar to that of stainless steel are required, from the view point of the strength, although the corrosion resistance thereof has no problem. Therefore, if there is stainless steel which has excellent corrosion resistance as well as strength similar to that of 4340 or 300M, it can be widely used to the application having strict requirements.

Further, since a high strength material has low toughness, there has been a desire to improve the toughness of the high strength material to a value as higher as possible in order to practically use the material and make use of the advantage of the high strength.

The high strength low alloy steel 4340 has the strength level of 180 Kgf/mm$^2$ and the fracture toughness value ($K_{IC}$ value) of about 200 Kgf/mm$^2$·$\sqrt{mm}$, and further, existing precipitation hardening type stainless steels have the toughness level of about 200 Kgf/mm$^2$·$\sqrt{mm}$ in the case of 17-4 PH and about 250 Kgf/mm$^2$·$\sqrt{mm}$ in the case of 15-5PH and PH13-8Mo when represented by a fracture toughness value ($K_{IC}$ value). More specifically, the precipitation hardening type stainless steels have not always high toughness, although they have a strength level lower than that of high strength low alloy steel.

On the other hand, examples of stainless steel having high strength and relatively high toughness are disclosed in Reissue U.S. Pat. No. 26,225 as heat resistant high strength stainless steel having very high strength and in U.S. Pat. No. 3,756,808 as stainless steel, respectively. U.S. Pat. No. 3,756,808 shows in FIG. 2 that the heat resistant high strength stainless steel 77 (AFC77, C; 0.16%, Cr; 14.36%, V; 0.48%, Mo; 4.90%, Co; 13.60%, N; 0.05%, Al; 0.042%, and residue; Fe) disclosed in Re. U.S. Pat. No. 26,225 and the stainless steel AFC260 (C; 0.07%, Si; 0.25%, Mn; 0.25%, Ni; 1.85%, Cr; 15.5%, Mo; 4.5%, Co; 13.0%, Nb; 0.15%, N; 0.03%, residue; Fe) and Alloy B (C; 0.16%, Ni; 1.03%, Cr; 13.94%, V; 0.09%, Mo; 5.22%, Co; 13.67%, Nb; 0.22%, N; 0.032%, residue; Fe) disclosed in U.S. Pat. No. 3,756,808 have strength and toughness higher than those of other precipitation hardening type high strength stainless steels represented by 17-4PH, 15-5PH, PH13-8Mo and the like. It is shown that Alloy B having the highest strength and toughness levels among them has a strength of 180 Kgf/mm$^2$ (about 260 Ksi) and the toughness thereof at this strength level is about 400 Kgf/mm$^2$·$\sqrt{mm}$ (about 115 Ksi $\sqrt{in}$). U.S. Pat. Nos. 3,756,808 and 3,873,378 show that the strength and toughness of this alloy greatly depend on heat treatment conditions. According to U.S. Pat. No. 3,756,808, the heat treatment conditions for providing Alloy B with such high strength and high toughness are such that Alloy B is austenitized by being kept at 927° C. for 1 hour and cooled to a room temperature, then again austenitized by being heated to 1150° C. and kept at this temperature for 1 hour, cooled to 1038° C. in this state and kept at this temperature for 1 hour and cooled to a room temperature, and further subjected to a sub zero treatment at −73° C. for 1 hour, and finally tempered twice at 427° C. for 2 hours.

In the above treatments, the first austenitizing treatment carried out at 927° C. is to adjust the size and distribution of a Nb carbide to thereby prevent crystalline grains from coarsening in the next second austenitizing treatment carried out at a high temperature. Further, the second austenitizing treatment carried out at 1150° C. and 1038° C. is to stabilize austenite at the high temperature of 1150° C. and to keep delta-ferrite as a brittle phase simultaneously made at this time at 1038° C. to thereby make the same disappear. When Alloy B is cooled after the austenitizing treatments, much retained austenite remains, and thus the toughness and elongation thereof can be increased. To increase the toughness and elongation by the adjustment of an amount of the residual austenite, however, the amount and distribution of the residual austenite must be well controlled, and when the size of Alloy B is large, it is feared that the control of the amount and distribution of the residual austenite may be difficult. Further, the tempering carried out at 427° C. is effective to increase strength.

As the result of a specific study of alloy having the composition of Alloy B carried out by the inventors using an experimental method, as shown in an embodiment, the high strength and high toughness disclosed in U.S. Pat. No. 3,756,808 could not be obtained, even if the above heat treatment was carried out, and only a low value of proof stress was obtained. As described above, it is very difficult to simultaneously obtain both high strength and high toughness in stainless steel.

OBJECT OF THE INVENTION

An object of the present invention is to provide a high strength, high toughness stainless steel having corrosion resistance similar to that of commercially available high strength stainless steel as well as higher strength and higher toughness than these of commercially available high strength stainless steel and a method of manufacturing the same.

The inventor has seriously studied chemical compositions and heat treatment conditions in a wide range to greatly improve the strength and toughness of the above AFC77, AFC260 and Alloy B without deteriorating the corrosion resistance thereof.

As a result, the inventor has found that, first, Nb and V form a primary carbide which prevents crystalline grains from coarsening, while the presence of these primary carbides lower toughness. Thus, toughness can be increased by not adding Nb and V or adding a smaller amount of them. Further, since much amount of Mo contained in the alloy also deteriorates toughness, the content of Mo is lowered to further improve the toughness. The inventors have also found that a relatively high amount of carbon may be added to enhance the strength of the alloy while keeping the high level of the toughness. And the inventors have also found and that a stainless steel having high strength and high toughness both of which are balanced with each other can be produced by positively adding Si which had rather been deemed to be an impurity in the prior art in the stainless steel to further improve the strength and by tempering the stainless steel at a temperature within a range of 120° to 450° C.

The invented steel contains Mo as a ferrite forming element by an amount which is much smaller than that of conventional steels such as AFC77, AFC260 and Alloy B, whereas contains a slightly more amount of austenite stabilizing elements, so that an austenitic structure is more stable and a delta-ferrite structure is difficult to appear. Thus, it has been newly found from an experiment that delta-ferrite does not remain in the invented steel and an amount of retained austenite sufficient to increase toughness can be obtained in such a manner that the invented steel is subjected to an austenitizing treatment of only one step instead of being subjected to the austenitizing treatment of two steps of high temperature and low temperature. Further, as a result of a specific study of an tempering temperature of the invented steel, new tempering conditions for obtaining high strength and high toughness have been found.

A high strength, high toughness stainless steel according to the first aspect of the present invention is characterized by consisting, by weight, of C more than 0.16% but less than 0.25%, Si not more than 2.0%, Mn not more than 1.0%, Ni not more than 2.0%, Cr from 11 to 15%, Mo not less than 0.5% but less than 3.0%, Co from 12 to 21%, and the balance Fe and incidental impurities.

A high strength, high toughness stainless steel according to the second aspect of the invention is characterized by consisting, by weight, of C from 0.17 to 0.23%, Si more than 0.25% but not more than 0.8% Mn not more than 1.0%, Ni from 0.5% to 1.5%, Cr from 12 to 13%, Mo from 1.5% to 2.5%, Co from 14.5% to 16.5%, and the balance Fe and incidental impurities.

A high strength, high toughness stainless steel according to the third aspect of the invention is characterized by consisting, by weight, of C more than 0.16% but less than 0.25%, Si not more than 2.0%, Mn not more than 1.0%, Ni not more than 2.0%, Cr from 11 to 15%, Mo not less than 0.5% but less than 3.0%, Co from 12% to 21%, at least one selected from the group consisting of V from 0.1% to 0.5% and Nb less than 0.1%, and the balance Fe and incidental impurities.

A high strength, high toughness stainless steel according to the fourth aspect of the invention is characterized by consisting, by weight, of C from 0.17% to 0.23%, Si more than 0.25% but not more than 0.8%, Mn not more than 1.0%, Ni from 0.5% to 1.5%, Cr from 12% to 13%, Mo from 1.5% to 2.5%, Co from 13.0% to 16.5%, at least one selected from the group consisting of V from 0.1% to 0.5% and Nb less than 0.1%, and the balance Fe and incidental impurities.

According to the fifth aspect of the invention there is provided a method of producing a high strength, high toughness stainless steel, characterized by comprising the steps of: preparing a stainless steel having the composition of any one of the claims 1 to 4; subjecting the stainless steel to a solution heat treatment at a temperature of 950° to 1150° C.; quenching the steel; subjecting the steel to a sub zero treatment at a temperature of −50° to −100° C.; and subjecting the steel to a tempering at a temperature of 120° to 450° C.

The function of each element and the reason why the heat treatment conditions are limited to the conditions shown above will be described below.

C is an element which greatly affects strength and toughness and added in an amount slightly higher than that of this kind of conventional alloys. When C is added in an amount of 0.16 wt % or less, strength is lowered, whereas when it is added in an amount of 0.25 wt % or more, toughness is lowered, and thus C is added in an amount exceeding 0.16 wt % but below 0.25 wt %, taking the balance between strength and toughness into consideration. It is preferably added in an amount of 0.17 to 0.23 wt %.

Si is an element which is effective to increase temper softening resistance and not only can increase an tempering temperature but also can increase strength at the same tempering temperature, and in particular is effective to improve strength at about from 300° to 400° C. rather than at about 120° C. When, however, Si is added in an amount exceeding 2.0 wt %, it degrades toughness and thus it is added in an amount of 2.0 wt % or less. The best balance between strength and toughness can be obtained when Si is added in an amount exceeding 0.25 wt % but not more than 0.8 wt %. When tempering may be carried out at a lower temperature from the view points of both strength and heat treatment conditions, Si is not always added in a large amount, but the addition of Si is more preferable.

Mn is an element which acts as a deoxidizer or desulfurizing agent, but not always needed when deoxidization and desulfurization have been sufficiently carried out. Even if Mn is added in an amount exceeding 1 wt %, further improvement cannot be expected, and thus it is added in an amount of 1 wt % or less, and a preferable amount of Mn is 0.5 wt % or less.

Ni is an element which is effective to increase toughness, but when it is added in an amount exceeding 2 wt %, austenite is stabilized to degrade proof stress and thus added in an amount of 2 wt % or less. It is preferably added in an amount of 0.5 to 1.5 wt %, taking the balance between strength and toughness into consideration.

Cr is an element which is effective to improve corrosion resistance, but an additive amount of Cr less than 11 wt % is not effective, whereas even if it is added in an amount exceeding 15 wt %, further improvement cannot be expected and strength is lowered, and thus it is added in an amount from 11 to 15 wt % and is preferably added in an amount from 12 to 13 wt %.

Mo is an element which is effective to increase strength and toughness, but an additive amount of Mo less than 0.5 wt % is not effective, whereas when it is added in an amount of 3 wt % or more, it forms ferrite or an intermetallic compound to degrade toughness, and thus it is added in an amount of 0.5 wt % or more but below 3 wt % and preferably in an amount from 1.5 to 2.5 wt %.

Co is an element which is effective to increase strength, but an additive amount of Co less than 12 wt % is not effective, whereas when it is added in an amount exceeding 21 wt %, it degrades toughness, and thus it is added in an amount from 12 to 21 wt % and preferably in an amount from 13 to 15 wt %.

Nb reacts with C to form a carbide and lowers the effect of C which is effective to strength and toughness, and thus it is limited to an amount less than 0.1 wt %. Further, although Nb has a effect to prevent crystalline grains from coarsening by forming the carbide, but the addition of Nb exceeding 0.1 wt % forms a coarse primary carbide to degrade hot-working properties and toughness, and thus it is important that Nb is limited in amount less than 0.1 wt %.

V reacts with C to form a carbide and has an effect to prevent crystalline grains from coarsening similarly to Nb, but the addition of only V is less effective and the addition of V together with Nb is more effective. However, an additive amount of V less than 0.1 wt % is less effective, while an additive amount exceeding 0.5 wt % cannot provide further improvement, and further an excessive addition forms a coarse primary carbide to degrade hot-working properties and toughness, and thus it is added in an amount from 0.1 to 0.5 wt %.

As described above, the addition of Nb and V in a small amount is effective in that it forms the primary carbide to prevent the crystalline grains from coarsening, and in the case of small steel ingot, Nb and V added in the above specified amounts effectively act without forming a coarse carbide. In the case of large steel ingot, however, the addition of Nb and V in the above specified amounts forms a coarse primary carbide which degrades hot-working properties and toughness, and thus it is rather preferable not to add Nb and V to the large dimension steel ingot in a practical use.

Next, a manufacturing method will be described.

A solution treatment not only makes alloy elements solid-solutioned into matrix but also provides an austenite structure at a high temperature, and the austenite structure is quickly cooled to obtain a martensite structure. When a solution treatment temperature is lower than 950° C., the alloy elements are not sufficiently solid-solutioned, whereas when it is higher than 1150° C., crystalline grains tend to be coarsened and further delta ferrite is formed to degrade mechanical properties, and thus the solution treatment temperature is set to 950° to 1150° C.

In the invented alloy, since a martensite transformation finishing point (Mf point) is lower than a room temperature, a perfect martensite structure cannot be obtained only by the quick cooling after the solution treatment and a large amount of the austenite structure remains to lower proof stress, and thus the alloy must be quickly cooled to the room temperature after the solution treatment and further subjected to a sub zero treatment at −50° to −100° C. A substantially an amount of retained austenite can be decreased by the sub zero treatment to improve mechanical properties such as proof stress.

After the sub zero treatment has been finished, the steel must be tempered at 120° to 450° C. to obtain well-balanced high strength and high toughness. When the tempering temperature is lower than 120° C., martensite is difficult to be decomposed by the precipitation of a Fe carbide, which results in high strength but low toughness, whereas when it is higher than 450° C., strength is increased but toughness is deteriorated by the precipitation hardening of a carbide caused by the tempering, and thus the tempering temperature is set to 120° to 450° C. Further, the addition of Si is preferable, as described above, to obtain higher strength and higher toughness with an tempering temperature set to a relatively higher value within the above range of the tempering temperature.

PREFERRED EMBODIMENT OF THE INVENTION

The present invention will be described below with reference to an embodiment.

Steel having a composition shown in Table 1 was melted in a vacuum furnace to produce ingot of 10 Kg. The thus obtained ingot was subjected to a homogenizing treatment at 1200° C. to 1300° C., made to a specimen having a rectangular cross section of 20 mm thick×45 mm width by a hot-working, and further annealed at 760° C. In Table 1, steels 1 to 32 are invented steels, steels 33 to 36 are comparative steels, and steels 37 and 38 are conventional steels, wherein the steel 37 is Alloy B disclosed in U.S. Pat. No. 3,756,808 and the steel 38 is AFC 77 disclosed in Re. U.S. Pat. No. 26,225. As shown in Table 2 to 4, these steels were treated by a method of the present invention, that is, they were subjected to a solution treatment at 950° to 1150° C. for 1 hour, quenched in oil, further subjected to a sub zero treatment at −75° C. for 2 hours, then subjected to tempering twice which tempering comprises keeping it within a temperature from 120° to 450° C. for 2 hours and air cooling. Further, some steels were tempered at a high temperature more than 450° C. after having been subjected to the solution treatment and sub zero treatment similar to those of the present invention for the purpose of comparison. In addition, the conventional steel 37 was heat treated by the method disclosed in U.S. Pat. No. 3,756,808, that is, it was subjected to an austenitizing treatment in such a manner that it was kept at 927° C. for 1 hour and air cooling, further kept at 1150° C. for 1 hour, cooled to 1038° C. and kept at this temperature for 1 hour and then air cooling, and thereafter it was subjected to a sub zero treatment at −75° C. for 2 hours and further tempered at 260° C. and 427° C. After the above respective heat treatments, the steels were subjected to a tensile test at room temperature to measure a 0.2% proof stress, tensile strength, elongation, and reduction of area. Further, a fracture toughness test was carried out at a room temperature to measure a fracture toughness value ($K_{IC}$).

TABLE 1

| Steel | Chemical compositions (wt %) | | | | | | | | | | |
|---|---|---|---|---|---|---|---|---|---|---|---|
| No. | C | Si | Mn | Ni | Cr | Mo | Co | V | Nb | Fe | Reference |
| 1 | 0.20 | 0.01 | 0.01 | 1.13 | 13.82 | 0.99 | 13.74 | — | 0.09 | Residue | Invented Steel |
| 2 | 0.20 | 0.01 | " | 1.21 | 12.43 | 2.01 | 13.82 | — | 0.08 | " | " |
| 3 | 0.21 | 0.01 | " | 0.93 | 14.08 | 2.00 | 13.83 | — | 0.08 | " | " |
| 4 | 0.20 | 0.01 | " | 0.92 | 14.13 | 1.99 | 17.00 | — | 0.08 | " | " |
| 5 | 0.21 | 0.01 | " | 0.01 | 14.04 | 1.99 | 13.79 | — | 0.08 | " | " |
| 6 | 0.20 | 0.03 | " | 0.01 | 14.09 | 1.98 | 16.62 | — | 0.08 | " | " |
| 7 | 0.19 | 0.01 | " | 0.99 | 12.61 | 1.98 | 13.79 | — | 0.07 | " | " |
| 8 | 0.21 | 0.50 | " | 0.94 | 12.55 | 1.98 | 13.75 | — | 0.08 | " | " |
| 9 | 0.22 | 1.01 | " | 0.94 | 12.61 | 1.98 | 13.78 | — | 0.08 | " | " |
| 10 | 0.20 | 1.50 | " | 0.94 | 12.63 | 1.98 | 13.83 | — | 0.08 | " | " |
| 11 | 0.21 | 1.99 | " | 0.94 | 12.58 | 1.98 | 13.88 | — | 0.08 | " | " |
| 12 | 0.20 | 1.00 | " | 0.94 | 12.60 | 1.98 | 13.77 | 0.21 | 0.08 | " | " |
| 13 | 0.17 | 0.78 | 0.01 | 0.95 | 12.54 | 1.99 | 13.99 | — | 0.08 | " | " |
| 14 | 0.21 | 0.73 | 0.01 | 0.94 | 12.51 | 1.98 | 13.78 | — | 0.08 | Residue | Invented Steel |
| 15 | 0.23 | 0.36 | " | 0.95 | 12.60 | 1.97 | 12.77 | — | 0.08 | " | " |
| 16 | 0.21 | 0.37 | " | 0.96 | 12.59 | 1.98 | 13.75 | — | 0.08 | " | " |
| 17 | 0.21 | 0.56 | " | 0.99 | 12.54 | 1.97 | 13.76 | 0.34 | 0.08 | " | " |
| 18 | 0.23 | 0.52 | " | 0.95 | 12.47 | 1.97 | 13.78 | — | 0.08 | " | " |
| 19 | 0.20 | 0.30 | " | 0.95 | 12.46 | 1.97 | 13.75 | — | 0.08 | " | " |
| 20 | 0.19 | 0.73 | " | 0.95 | 12.47 | 1.98 | 13.78 | — | 0.08 | " | " |
| 21 | 0.20 | 0.51 | " | 0.95 | 12.51 | 1.98 | 15.16 | — | 0.08 | " | " |
| 22 | 0.20 | 0.51 | " | 0.95 | 12.51 | 1.97 | 17.06 | — | 0.08 | " | " |
| 23 | 0.19 | 0.50 | " | 0.98 | 12.64 | 1.95 | 13.67 | — | 0.02 | " | " |
| 24 | 0.20 | 0.49 | 0.02 | 0.94 | 12.55 | 1.97 | 15.08 | — | 0.02 | " | " |
| 25 | 0.19 | 0.49 | 0.02 | 0.94 | 12.56 | 1.96 | 20.10 | — | — | " | " |
| 26 | 0.19 | 0.49 | 0.02 | 0.96 | 12.54 | 1.49 | 15.10 | 0.46 | — | " | " |
| 27 | 0.19 | 0.49 | 0.01 | 0.96 | 12.53 | 1.48 | 14.95 | 0.33 | — | Residue | Invented Steel |
| 28 | 0.19 | 0.50 | 0.01 | 0.95 | 12.53 | 1.48 | 15.02 | — | — | " | " |
| 29 | 0.19 | 0.49 | 0.46 | 0.95 | 12.67 | 1.49 | 15.10 | — | — | " | " |
| 30 | 0.20 | 0.51 | 0.51 | 1.03 | 12.59 | 1.98 | 15.40 | — | — | " | " |
| 31 | 0.20 | 0.52 | 0.51 | 1.02 | 12.66 | 1.99 | 15.56 | — | — | " | " |
| 32 | 0.21 | 0.50 | 0.43 | 1.18 | 12.53 | 2.06 | 15.95 | — | — | " | " |
| 33 | 0.20 | 0.01 | 0.01 | 2.48 | 11.94 | 0.99 | 13.64 | — | 0.10 | " | Comparative Steel |
| 34 | 0.20 | 0.01 | " | 2.49 | 10.53 | 1.98 | 13.67 | — | 0.10 | " | " |
| 35 | 0.15 | 0.01 | " | 0.93 | 14.01 | 1.99 | 13.76 | — | 0.08 | " | " |
| 36 | 0.25 | 0.01 | " | 0.93 | 14.09 | 2.00 | 13.88 | — | 0.08 | " | " |
| 37 | 0.16 | 0.03 | " | 1.09 | 13.99 | 4.95 | 13.94 | — | 0.27 | " | Conventional Steel |
| 38 | 0.15 | — | " | 0.14 | 14.13 | 4.80 | 13.33 | 0.21 | — | " | " |

TABLE 2

| Steel No. | Solution Treatment | Sub Zero Treatment | Tempering (Twice) | 0.2 Proof Stress (kgf/mm$^2$) | Tensile strength (kgf/mm$^2$) | Elongation (%) | Reduction of Area (%) | $K_{IC}$ (kgf/mm$^2$ · $\sqrt{mm}$) | Reference | |
|---|---|---|---|---|---|---|---|---|---|---|
| 1 | 1038° C. × 1 h. o.c.* | −75° C. × 2 h | 149° C. × 2h, A.C.** | 142.9 | 182.7 | 19.5 | 58.0 | 320.9 | Invented steel | Method of present Invention |
| 1 | 1038° C. × 1 h. o.c.* | −75° C. × 2 h | 204° C. × 2h, A.C. | 136.8 | 179.1 | 17.9 | 58.9 | 427.4 | Invented steel | Method of present Invention |
| 2 | 1038° C. × 1 h. o.c.* | −75° C. × 2 h | 149° C. × 2h, A.C. | 149.4 | 187.2 | 12.6 | 35.5 | 394.0 | Invented steel | Method of present Invention |
| 2 | 1038° C. × 1 h. o.c.* | −75° C. × 2 h | 204° C. × 2h, A.C. | 14.27 | 180.0 | 16.7 | 56.2 | 489.8 | Invented steel | Method of present Invention |
| 3 | 1038° C. × 1 h. o.c.* | −75° C. × 2 h | 149° C. × 2h, A.C. | 143.3 | 190.6 | 14.8 | 43.3 | 256.4 | Invented steel | Method of present Invention |
| 3 | 1038° C. × 1 h. o.c.* | −75° C. × 2 h | 204° C. × 2h, A.C. | 136.6 | 176.4 | 18.7 | 56.5 | 351.9 | Invented steel | Method of present Invention |
| 4 | 1038° C. × 1 h. o.c.* | −75° C. × 2 h | 149° C. × 2h, A.C. | 129.1 | 189.0 | 20.7 | 56.0 | 295.4 | Invented steel | Method of present Invention |
| 4 | 1038° C. × 1 h. o.c.* | −75° C. × 2 h | 204° C. × 2h, A.C. | 124.4 | 176.4 | 20.9 | 59.0 | 485.9 | Invented steel | Method of present Invention |
| 5 | 1038° C. × 1 h. o.c.* | −75° C. × 2 h | 204° C. × 2h, A.C. | 137.5 | 176.1 | 9.6 | 18.5 | 346.2 | Invented steel | Method of present |

TABLE 2-continued

| Steel No. | Solution Treatment | Sub Zero Treatment | Tempering (Twice) | 0.2 Proof Stress (kgf/mm²) | Tensile strength (kgf/mm²) | Elongation (%) | Reduction of Area (%) | $K_{IC}$ (kgf/mm² · √mm) | Reference | |
|---|---|---|---|---|---|---|---|---|---|---|
| 6 | 1038° C. × 1 h. o.c.* | −75° C. × 2 h | 149° C. × 2h, A.C. | 138.8 | 193.7 | 8.9 | 13.0 | 257.6 | Invented steel | Invention Method of present Invention |
| 6 | 1038° C. × 1 h. o.c.* | −75° C. × 2 h | 204° C. × 2h, A.C. | 138.1 | 181.7 | 18.7 | 54.0 | 354.4 | Invented steel | Invention Method of present Invention |
| 7 | 1038° C. × 1 h. o.c.* | −75° C. × 2 h | 204° C. × 2h, A.C. | 139.8 | 176.4 | 15.6 | 45.2 | 497.4 | Invented steel | Invention Method of present Invention |
| 8 | 1038° C. × 1 h. o.c.* | −75° C. × 2 h | 204° C. × 2h, A.C. | 144.9 | 182.7 | 16.1 | 45.4 | 438.2 | Invented steel | Invention Method of present Invention |
| 8 | 1038° C. × 1 h. o.c.* | −75° C. × 2 h | 260° C. × 2h, A.C. | 136.7 | 177.3 | 20.4 | 60.2 | 377.7 | Invented steel | Invention Method of present Invention |
| 8 | 1038° C. × 1 h. o.c.* | −75° C. × 2 h | 316° C. × 2h, A.C. | 137.2 | 180.5 | 16.7 | 58.2 | 369.5 | Invented steel | Invention Method of present Invention |
| 9 | 1038° C. × 1 h. o.c.* | −75° C. × 2 h | 204° C. × 2h, A.C. | 143.0 | 183.6 | 14.6 | 32.9 | 301.5 | Invented steel | Invention Method of present Invention |
| 9 | 1038° C. × 1 h. o.c.* | −75° C. × 2 h | 260° C. × 2h, A.C. | 139.1 | 178.0 | 17.8 | 55.1 | 285.1 | Invented steel | Invention Method of present Invention |
| 10 | 1038° C. × 1 h. o.c.* | −75° C. × 2 h | 204° C. × 2h, A.C. | 140.9 | 182.9 | 18.3 | 40.5 | 345.2 | Invented steel | Invention Method of present Invention |
| 10 | 1038° C. × 1 h. o.c.* | −75° C. × 2 h | 260° C. × 2h, A.C. | 140.9 | 176.9 | 18.7 | 52.2 | 359.1 | Invented steel | Invention Method of present Invention |
| 11 | 1038° C. × 1 h. o.c.* | −75° C. × 2 h | 204° C. × 2h, A.C. | 135.8 | 181.7 | 18.1 | 44.0 | 302.4 | Invented steel | Invention Method of present Invention |
| 11 | 1038° C. × 1 h. o.c.* | −75° C. × 2 h | 260° C. × 2h, A.C. | 140.3 | 179.1 | 20.1 | 56.5 | 303.8 | Invented steel | Invention Method of present Invention |
| 12 | 1038° C. × 1 h. o.c.* | −75° C. × 2 h | 204° C. × 2h, A.C. | 141.7 | 179.7 | 16.8 | 42.0 | 339.5 | Invented steel | Invention Method of present Invention |
| 12 | 1038° C. × 1 h. o.c.* | −75° C. × 2 h | 260° C. × 2h, A.C. | 132.4 | 174.4 | 18.8 | 56.9 | 361.3 | Invented steel | Invention Method of present Invention |
| 13 | 1038° C. × 1 h. o.c.* | −75° C. × 2 h | 204° C. × 2h, A.C. | 139.5 | 176.1 | 17.3 | 55.0 | 446.5 | Invented steel | Invention Method of present Invention |

TABLE 3

| Steel No. | Solution Treatment | Sub Zero Treatment | Tempering (Twice) | 0.2 Proof Stress (kgf/mm²) | Tensile strength (kgf/mm²) | Elongation (%) | Reduction of Area (%) | $K_{IC}$ (kgf/mm² · √mm) | Reference | |
|---|---|---|---|---|---|---|---|---|---|---|
| 14 | 1038° C. × 1 h. o.c. | −75° C. × 2 h | 204° C. × 2h, A.C. | 143.8 | 182.7 | 19.5 | 58.0 | 320.9 | Invented steel | Method of present Invention |
| 14 | 1038° C. × 1 h. o.c. | −75° C. × 2 h | 316° C. × 2h, A.C. | 135.4 | 176.9 | 16.0 | 50.5 | 354.2 | Invented steel | Method of present Invention |
| 15 | 1038° C. × 1 h. o.c. | −75° C. × 2 h | 204° C. × 2h, A.C. | 132.8 | 175.5 | 18.1 | 58.9 | 393.3 | Invented steel | Method of present Invention |
| 16 | 1038° C. × 1 h. o.c. | −75° C. × 2 h | 204° C. × 2h, A.C. | 140.2 | 181.9 | 16.7 | 54.0 | 422.2 | Invented steel | Method of present Invention |
| 16 | 1038° C. × 1 h. o.c. | −75° C. × 2 h | 316° C. × 2h, A.C. | 131.5 | 179.8 | 17.0 | 59.7 | 359.3 | Invented steel | Method of present Invention |
| 17 | 1038° C. × 1 h. o.c. | −75° C. × 2 h | 204° C. × 2h, A.C. | 128.4 | 179.9 | 8.9 | 17.7 | 385.7 | Invented steel | Method of present Invention |
| 17 | 1038° C. × 1 h. o.c. | −75° C. × 2 h | 316° C. × 2h, A.C. | 132.7 | 181.4 | 16.1 | 60.3 | 356.7 | Invented steel | Method of present Invention |

TABLE 3-continued

| Steel No. | Solution Treatment | Sub Zero Treatment | Tempering (Twice) | 0.2 Proof Stress (kgf/mm$^2$) | Tensile strength (kgf/mm$^2$) | Elon-gation (%) | Reduc-tion of Area (%) | $K_{IC}$ (kgf/mm$^2$ · √mm) | Reference | |
|---|---|---|---|---|---|---|---|---|---|---|
| 18 | 1038° C. × 1 h. o.c. | −75° C. × 2 h | 204° C. × 2h, A.C. | 138.6 | 184.5 | 7.3 | 12.5 | 278.2 | Invented steel | Method of present Invention |
| 19 | 1038° C. × 1 h. o.c. | −75° C. × 2 h | 204° C. × 2h, A.C. | 133.8 | 181.2 | 10.2 | 18.9 | 497.5 | Invented steel | Method of present Invention |
| 19 | 1038° C. × 1 h. o.c. | −75° C. × 2 h | 316° C. × 2h, A.C. | 131.2 | 179.7 | 16.9 | 60.2 | 333.9 | Invented steel | Method of present Invention |
| 20 | 1038° C. × 1 h. o.c. | −75° C. × 2 h | 204° C. × 2h, A.C. | 131.4 | 178.2 | 17.7 | 54.1 | 524.4 | Invented steel | Method of present Invention |
| 20 | 1038° C. × 1 h. o.c. | −75° C. × 2 h | 316° C. × 2h, A.C. | 128.6 | 176.9 | 17.5 | 63.8 | 348.3 | Invented steel | Method of present Invention |
| 21 | 1038° C. × 1 h. o.c. | −75° C. × 2 h | 204° C. × 2h, A.C. | 134.0 | 181.2 | 11.2 | 27.0 | 471.3 | Invented steel | Method of present Invention |
| 21 | 1038° C. × 1 h. o.c. | −75° C. × 2 h | 316° C. × 2h, A.C. | 130.5 | 179.8 | 18.5 | 62.3 | 452.9 | Invented steel | Method of present Invention |
| 21 | 1038° C. × 1 h. o.c. | −75° C. × 2 h | 350° C. × 2h, A.C. | 137.4 | 182.0 | 16.3 | 54.1 | 349.6 | Invented steel | Method of present Invention |
| 22 | 1038° C. × 1 h. o.c. | −75° C. × 2 h | 204° C. × 2h, A.C. | 136.1 | 180.6 | 17.5 | 51.7 | 442.9 | Invented steel | Method of present Invention |
| 22 | 1038° C. × 1 h. o.c. | −75° C. × 2 h | 316° C. × 2h, A.C. | 129.7 | 178.0 | 17.3 | 61.5 | 401.4 | Invented steel | Method of present Invention |
| 22 | 1038° C. × 1 h. o.c. | −75° C. × 2 h | 350° C. × 2h, A.C. | 138.5 | 182.9 | 18.5 | 61.8 | 274.7 | Invented steel | Method of present Invention |
| 23 | 1038° C. × 1 h. o.c. | −75° C. × 2 h | 316° C. × 2h, A.C. | 140.3 | 176.6 | 17.7 | 59.9 | 393.3 | Invented steel | Method of present Invention |
| 24 | 1038° C. × 1 h. o.c. | −75° C. × 2 h | 316° C. × 2h, A.C. | 128.3 | 177.2 | 16.9 | 57.3 | 437.7 | Invented steel | Method of present Invention |
| 25 | 1038° C. × 1 h. o.c. | −75° C. × 2 h | 371° C. × 2h, A.C. | 135.4 | 181.4 | 19.7 | 59.8 | 273.3 | Invented steel | Method of present Invention |
| 26 | 1038° C. × 1 h. o.c. | −75° C. × 2 h | 316° C. × 2h, A.C. | 126.5 | 175.3 | 18.5 | 57.3 | 438.3 | Invented steel | Method of present Invention |
| 27 | 1038° C. × 1 h. o.c. | −75° C. × 2 h | 316° C. × 2h, A.C. | 124.2 | 177.2 | 19.3 | 58.7 | 444.3 | Invented steel | Method of present Invention |
| 28 | 1038° C. × 1 h. o.c. | −75° C. × 2 h | 316° C. × 2h, A.C. | 127.2 | 178.0 | 16.3 | 59.1 | 483.4 | Invented steel | Method of present Invention |
| 28 | 1038° C. × 1 h. o.c. | −75° C. × 2 h | 371° C. × 2h, A.C. | 140.1 | 186.8 | 16.1 | 55.6 | 254.5 | Invented steel | Method of present Invention |

TABLE 4

| Steel No. | Solution Treatment | Sub Zero Treatment | Tempering (Twice) | 0.2 Proof Stress (kgf/mm$^2$) | Tensile strength (kgf/mm$^2$) | Elon-gation (%) | Reduc-tion of Area (%) | $K_{IC}$ (kgf/mm$^2$ · √mm) | Reference | |
|---|---|---|---|---|---|---|---|---|---|---|
| 29 | 1038° C. × 1 h, o.c. | −75° C. × 2 h | 316° C. × 2 h, A.C. | 127.5 | 177.1 | 18.1 | 60.1 | 442.8 | Invented Steel | Method of Present Invention |
| 30 | 1010° C. × 1 h, o.c. | " | 316° C. × 2 h, A.C. | 133.5 | 175.6 | 15.7 | 15.7 | 251.4 | Invented Steel | Method of Present Invention |
| 30 | 1040° C. × 1 h, o.c. | " | 316° C. × 2 h, A.C. | 131.0 | 176.6 | 18.9 | 61.7 | 398.3 | Invented Steel | Method of Present Invention |
| 30 | 1070° C. × 1 h, o.c. | " | 316° C. × 2 h, A.C. | 128.4 | 176.8 | 17.5 | 52.7 | 444.9 | Invented Steel | Method of Present Invention |
| 30 | 1070° C. × 1 h, o.c. | " | 371° C. × 2 h, A.C. | 137.3 | 181.1 | 19.5 | 57.4 | 494.3 | Invented Steel | Method of Present |

TABLE 4-continued

| Steel No. | Solution Treatment | Sub Zero Treatment | Tempering (Twice) | 0.2 Proof Stress (kgf/mm$^2$) | Tensile strength (kgf/mm$^2$) | Elongation (%) | Reduction of Area (%) | $K_{IC}$ (kgf/mm$^2$ · $\sqrt{mm}$) | Reference | |
|---|---|---|---|---|---|---|---|---|---|---|
| 31 | 1100° C. × 1 h, o.c. | " | 316° C. × 2 h, A.C. | 121.6 | 176.0 | 18.3 | 52.1 | 548.6 | Invented Steel | Invention Method of Present Invention |
| 31 | 1100° C. × 1 h, o.c. | " | 371° C. × 2 h, A.C. | 132.3 | 181.7 | 18.7 | 53.6 | 527.9 | Invented Steel | Invention Method of Present Invention |
| 32 | 1085° C. × 1 h, o.c. | " | 343° C. × 2 h, A.C. | 129.0 | 179.0 | 20.1 | 56.5 | 540.2 | Invented Steel | Invention Method of Present Invention |
| 32 | 1085° C. × 1 h, o.c. | " | 371° C. × 2 h, A.C. | 129.7 | 181.8 | 19.7 | 55.5 | 495.2 | Invented Steel | Invention Method of Present Invention |
| 32 | 1085° C. × 1 h, o.c. | " | 385° C. × 2 h, A.C. | 134.8 | 184.4 | 18.6 | 52.2 | 441.2 | Invented Steel | Invention Method of Present Invention |
| 32 | 1085° C. × 1 h, o.c. | " | 399° C. × 2 h, A.C. | 137.5 | 185.5 | 19.5 | 54.4 | 352.0 | Invented Steel | Invention Method of Present Invention |
| 32 | 1085° C. × 1 h, o.c. | " | 427° C. × 2 h, A.C. | 148.0 | 192.7 | 19.1 | 49.3 | 252.4 | Invented Steel | Invention Method of Present Invention |
| 32 | 1085° C. × 1 h, o.c. | " | 454° C. × 2 h, A.C. | 148.0 | 201.6 | 16.9 | 40.6 | 207.6 | Invented Steel | Comparative Method |
| 33 | 1038° C. × 1 h, o.c. | " | 260° C. × 2 h, A.C. | 129.8 | 167.2 | 18.6 | 64.7 | 521.3 | Comparative Steel | Method of Present Invention |
| 34 | 1038° C. × 1 h, o.c. | " | 260° C. × 2 h, A.C. | 130.7 | 170.1 | 17.8 | 63.4 | 544.4 | Comparative Steel | Method of Present Invention |
| 35 | 1038° C. × 1 h, o.c. | " | 149° C. × 2 h, A.C. | 130.3 | 164.2 | 17.7 | 54.9 | 516.9 | Comparative Steel | Method of Present Invention |
| 36 | 1038° C. × 1 h, o.c. | " | 149° C. × 2 h, A.C. | 149.8 | 191.5 | 5.3 | 9.2 | 147.2 | Comparative Steel | Method of Present Invention |
| 36 | 1038° C. × 1 h, o.c. | " | 204° C. × 2 h, A.C. | 143.5 | 180.8 | 16.7 | 52.3 | 213.9 | Comparative Steel | Method of Present Invention |
| 37 | 927° C. × 1 h, o.c. + 1150° C. × 1 h → 1038° C. × 1 h, o.c. | −75° × 2 h | 260° C. × 2 h, A.C. | 109.3 | 158.7 | 20.7 | 57.4 | 267.8 | Conventional Steel | Comparative Method |
| 37 | 927° C. × 1 h, o.c. + 1150° C. × 1 h → 1038° C. × 1 h, o.c. | " | 427° C. × 2 h, A.C. | 129.1 | 168.2 | 23.0 | 59.2 | 241.7 | Conventional Steel | Comparative Method |
| 38 | 1038° C. × 1 h, o.c. | " | 260° C. × 2 h, A.C. | 130.3 | 168.9 | 18.2 | 49.0 | 273.2 | Conventional Steel | Method of Present Invention |
| 38 | 1038° C. × 1 h, o.c. | " | 316° C. × 2 h, A.C. | 127.0 | 167.1 | 19.3 | 63.2 | 337.3 | Conventional Steel | Method of Present Invention |
| 38 | 1038° C. × 1 h, o.c. | " | 371° C. × 2 h, A.C. | 130.5 | 170.6 | 19.5 | 60.3 | 263.1 | Conventional Steel | Method of Present Invention |
| 38 | 1038° C. × 1 h, o.c. | " | 427° C. × 2 h, A.C. | 141.5 | 177.7 | 19.1 | 61.1 | 135.5 | Conventional Steel | Method of Present Invention |
| 38 | 1038° C. × 1 h, o.c. | " | 482° C. × 2 h, A.C. | 145.8 | 187.4 | 19.7 | 59.4 | 112.5 | Conventional Steel | Comparative Method |
| 38 | 1038° C. × 1 h, o.c. | " | 538° C. × 2 h, A.C. | 145.5 | 195.9 | 16.7 | 60.2 | 115.3 | Conventional Steel | Comparative Method |
| 1 | 1038° C. × 1 h, o.c. | " | 482° C. × 2 h, A.C. | 141.3 | 191.5 | 20.1 | 55.7 | 120.0 | Invented Steel | Comparative Method |
| 2 | 1038° C. × 1 h, o.c. | " | 482° C. × 2 h, A.C. | 143.3 | 189.0 | 16.7 | 63.5 | 93.1 | Invented Steel | Comparative Method |

TABLE 5

| Steel No. | Rusting Test Result by 5% saline solution spray at 35° C. for 200 hours | Remarks |
|---|---|---|
| 1 | Not Rusted | Invented Steel |
| 2 | " | " |
| 3 | " | " |
| 4 | " | " |
| 5 | " | " |
| 6 | " | " |
| 7 | " | " |
| 8 | " | " |
| 9 | " | " |
| 10 | " | " |
| 11 | " | " |
| 12 | " | " |
| 13 | " | " |
| 14 | " | " |
| 15 | " | " |
| 16 | " | " |
| 17 | " | " |
| 18 | " | " |
| 19 | " | " |
| 20 | " | " |
| 21 | " | " |
| 22 | " | " |
| 23 | " | " |
| 24 | Not Rusted | Invented Steel |
| 25 | " | " |
| 26 | " | " |
| 27 | " | " |
| 28 | " | " |
| 29 | " | " |
| 30 | " | " |
| 31 | " | " |
| 32 | " | " |
| 37 | Not Rusted | Conventional Steel |

As shown in Table 2 to Table 4, all of the invented steels 1 to 32 heat treated by the method of the present invention are found to have a high tensile strength of about 175 Kgf/mm$^2$ or more and a high fracture toughness of about 250 kgf/mm$^2$·$\sqrt{\text{mm}}$ or more. As shown in the last two lines of Table 4, however, it is found that when the invented steels 1 and 2 were tempered at 482° C. which was higher than the tempering temperature of the method according to the present invention, the toughness thereof was greatly lowered, whereas when the method according to the present invention having an tempering temperature from 120° to 450° C. was used, high proof stress, high strength and high toughness could be obtained, as shown in the invented steels 1 to 32. In addition, the comparative steels 33 to 36 are low in any one of a tensile strength and fracture toughness, even if they were treated by the method according to the present invention, and thus they do not have high strength and high toughness at the same time. The conventional steels 37 and 38 are low in any one or both of a tensile strength and fracture toughness even if they were treated by the method according to the present invention, by the conventional method disclosed in U.S. Pat. No. 3,756,808, or by a comparative method [a method of tempering at a temperature higher than that of the present invention (a temperature exceeding 450° C.)], and thus they do not satisfy high strength and high toughness properties at the same time, although the reason of which is not apparent.

Further, the corrosion resistance of the invented steels 1 to 32 and the conventional steels 37 was tested by a saline solution spray test, and the result of them is shown in Table 5. It is found that the invented steels do not cause rusting similarly to the conventional steels and thus have good corrosion resistance.

As described above, the invented steels are stainless steel having high strength, high toughness and good corrosion resistance which are not obtained in conventional stainless steels, and when subjected to a suitable heat treatment according to the present invention, they can be used as materials which simultaneously require high strength, high toughness and high corrosion resistance, for example a landing gear member or bolt member of an aircraft, which results in a great industrial effect that the weight of the members and parts can be reduced as compared with conventional steels and the reliability and life thereof as a high strength material are improved, even if they are used in a SERVERE corrosive circumference.

What is claimed is:

1. A high strength, high toughness martensitic stainless steel consisting, by weight, of C more than 0.16% but less than 0.25%, Si not more than 2.0%, Mn not more than 1.0%, Ni not more than 2.0%, Cr from 11 to 15%, Mo not less than 0.5% but less than 3.0%, Co from 12 to 21%, and the balance Fe and incidental impurities, said martensitic stainless steel having a tensile strength not less than 175 kgf/mm$^2$ and a fracture toughness not less than 250 kgf/mm$^2$·$\sqrt{\text{mm}}$ at room temperature.

2. A high strength, high toughness martensitic stainless steel consisting, by weight, of C from 0.17 to 0.23%, Si more than 0.25% but not more than 0.8%, Mn not more than 1.0%, Ni from 0.5% to 1.5%, Cr from 12 to 13%, Mo from 1.5% to 2.5%, Co from 14.5% to 16.5%, and the balance Fe and incidental impurities, said martensitic stainless steel having a tensile strength not less than 175 kgf/mm$^2$ and a fracture toughness not less than 250 kgf/mm$^2$·$\sqrt{\text{mm}}$ at room temperature.

3. A high strength, high toughness martensitic stainless steel consisting, by weight, of C more than 0.16% but less than 0.25%, Si not more than 2.0%, Mn not more than 1.0%, Ni not more than 2.0%, Cr from 11 to 15%, Mo not less than 0.5% but less than 3.0%, Co from 12% to 21%, V from 0.1% to 0.5%, and the balance Fe and incidental impurities, said martensitic stainless steel having a tensile strength not less than 175 kgf/mm$^2$ and a fracture toughness not less than 250 kgf/mm$^2$·$\sqrt{\text{mm}}$ at room temperature.

4. A high strength, high toughness martensitic stainless steel consisting, by weight, of C from 0.17% to 0.23%, Si more than 0.25% but not more than 0.8%, Mn not more than 0.1%, Ni 0.05% to 1.5%, Cr from 12% to 13%, Mo from 1.5% to 2.5%, Co from 13.0% to 16.5%, V from 0.1% to 0.5%, and the balance of Fe and incidental impurities, said martensitic stainless steel having a tensile strength not less than 175 kgf/mm$^2$ and a fracture toughness not less than 250 kgf/mm$^2$·$\sqrt{\text{mm}}$ at room temperature.

5. A high strength, high toughness martensitic stainless steel according to claim 1, wherein said martensitic stainless steel has an amount of retained austenite sufficient to increase toughness.

6. A high strength, high toughness martensitic stainless steel according to claim 2, wherein said martensitic stainless steel has an amount of retained austenite sufficient to increase toughness.

7. A high strength, high toughness martensitic stainless steel according to claim 3, wherein said martensitic stainless steel has an amount of retained austenite sufficient to increase toughness.

8. A high strength, high toughness martensitic stainless steel according to claim 4, wherein said martensitic stainless steel has an amount of retained austenite sufficient to increase toughness.

* * * * *